US005529013A

United States Patent [19]

Eva, III et al.

[11] Patent Number: 5,529,013

[45] Date of Patent: Jun. 25, 1996

[54] FLOATING DRIVE-ON DRY DOCK ASSEMBLY

[76] Inventors: W. Allan Eva, III; David T. Faber, both of 500 SW. 21st Terr., Suite B107, Fort Lauderdale, Fla. 33312

[21] Appl. No.: 500,582

[22] Filed: Jul. 11, 1995

[51] Int. Cl.[6] ..... B63B 35/44

[52] U.S. Cl. ..... 114/263; 114/266

[58] Field of Search ..... 114/263, 266, 114/267, 45, 46, 262; 14/27; 405/219

[56] References Cited

U.S. PATENT DOCUMENTS

| | | | |
|---|---|---|---|
| 1,791,305 | 2/1931 | Gerli | 114/262 |
| 2,453,155 | 11/1948 | Nelson et al. | 114/266 |
| 2,692,101 | 10/1954 | Doolittle et al. | 114/262 X |
| 2,742,012 | 4/1956 | Bridges | 114/46 |
| 3,788,254 | 1/1974 | Sheil | 114/266 |
| 3,824,644 | 7/1974 | Stranzinger | 14/27 |
| 4,604,962 | 8/1986 | Guibault | 114/266 |

*Primary Examiner*—Sherman Basinger
*Attorney, Agent, or Firm*—Renner, Otto, Boisselle & Sklar

[57] ABSTRACT

A floating, drive-on dry dock assembly for a small craft is assembled from two kinds of hollow floatation units, tall units and short units. The units are interconnected so that their top surfaces are substantially coplanar. The units are arranged to form two arms which support the hull of the craft on each side of the longitudinal center line of the craft. The entire length of each arm is made up of tall units except the distal end portions of each arm which may be made up of short units. The short units are able to flex downward as a craft begins to ride up on the dock because of the location of the connection between adjacent units. The tall units, however, cannot flex relative to each other nearly to the same extent as the short units, and so they form a stable generally planar surface. The distal ends of the arms are connected to each other by an upside down short unit. The short units are proportioned so that the uppermost surface of each is out of the water both when the dock is empty and when a craft is "parked" on the dock.

19 Claims, 10 Drawing Sheets

FLOATING DRIVE-ON DRY DOCK ASSEMBLY

FIELD OF THE INVENTION

The present invention relates to floating dry docks and particularly to an improved floating dry dock for small craft including personal watercraft.

BACKGROUND OF THE INVENTION

In the past floating dry docks have been created by the assembly of a number of identical floating subunits. These units have been roughly cubical with tabs projecting from the vertical edges at or near the horizontal midline. By fastening adjacent tabs to each other, a floating dock with a substantially flat deck surface of any desired configuration could be assembled.

Examples of such units and docks assembled from such units are found in U.S. Pat. Nos. 3,824,664 and 4,604,962. These patents describe hollow cubical units which in practice have been manufactured about 16 inches on a side. The units have been molded from a suitable plastic material with the tabs which project from each vertical edge positioned so that a dock of virtually any shape with a flat deck or top surface could be formed. The units have also been provided with bungholes so that the units could be partially flooded to lower the water line of some or all of the units. This has been done particularly where the dock has been used for personal watercraft.

With a personal watercraft, such as a jet ski, or with other small craft, such as a motor boat or jet boat under about 18 feet in length, the goal of the floating dry dock has been to make it possible to drive the craft up onto the dock. This would enable the driver to get on and off the craft without getting in the water and would also permit the craft to be stored out of the water.

Attempts to accomplish these goals have not been entirely successful. The dry docks assembled from prior art units have been either too high above the water to permit a personal watercraft to be driven on, or too low to keep the driver and craft out of the water entirely. Keeping the craft high and dry when not in use is important to protecting the machinery of the craft. In addition, the surfaces of the dock which the craft slides over must be ordinarily above the water line, otherwise marine growths, such as barnacles, will develop and scratch the smooth bottom surface to the craft, doing damage each time the craft slides onto or off of the dock.

The prior art has also included floating units like those shown in the patents identified above, but shorter. These units were about 16 inches square in plan view, but only about 10 inches tall. In addition, in these shorter units the tabs were still about 8 inches down from the deck surface and correspondingly closer to the bottom surface. These shorter units have been thought useful for assembling docks for light watercraft such as the shells used by college crew teams.

SUMMARY OF THE INVENTION

The present invention provides a unique floating drive-on dry dock for personal watercraft or small craft under about 18 feet in length. The dock is assembled from a combination of tall and short hollow, air-tight floatation units. The tall units are roughly cubical and have tabs projecting from about midway along each vertical edge. The short units which have tabs positioned to make a deck continuous with the deck formed by the tall units and which are able to flex downward when a craft is driven onto the dock but which resist flexion in the opposite direction when the craft is in place, to thereby form a rigid, stable surface that can be walked on.

Accordingly, the present invention provides a floating drive-on dry dock formed from a plurality of float units each with a generally flat top or deck surface, the float units being connected together so that their top surfaces form a generally planar and horizontal deck. Each float unit has at least one side wall which faces an opposing side wall on an adjacent float unit. The float units each have a pivotable connection to the adjacent float units, the connections being above the water line when the dock is floating freely and a fixed distance below the deck surface of the float unit. The connections enable adjacent float units to rotate with respect to each other until the respective facing side walls come into contact with each other. A first group of the float units have bottom surfaces located substantially as far below the pivotable connection as their deck surfaces are above the pivotable connection whereby they can rotate downward to the same extent that they can rotate upward before the respective facing side walls come into contact with each other. A second group of float units have bottom surfaces located substantially closer to the pivotable connection whereby they can rotate downward substantially without limitation. The floating drive-on dry dock has a pair of parallel arms formed at least in part of float units from the second group of float units, and there is a bridging unit between the parallel arms, the bridging unit having a top surface which is above the water surface when the dock is floating freely.

The floating drive-on dry dock so constructed has surfaces on which the watercraft slides which are submerged only while the watercraft is being ridden onto the dock, but which remain above the surface both before and after the craft is driven onto the dock. The result is a dock that does not accumulate barnacles or other harmful marine growth. Moreover, the ability of the short units to permit flexion in one direction but not in the other permits them to flex downward while a watercraft is being driven onto the dock and to form a rigid deck once the craft is in place.

DESCRIPTION OF PREFERRED EMBODIMENT

Figure 1:
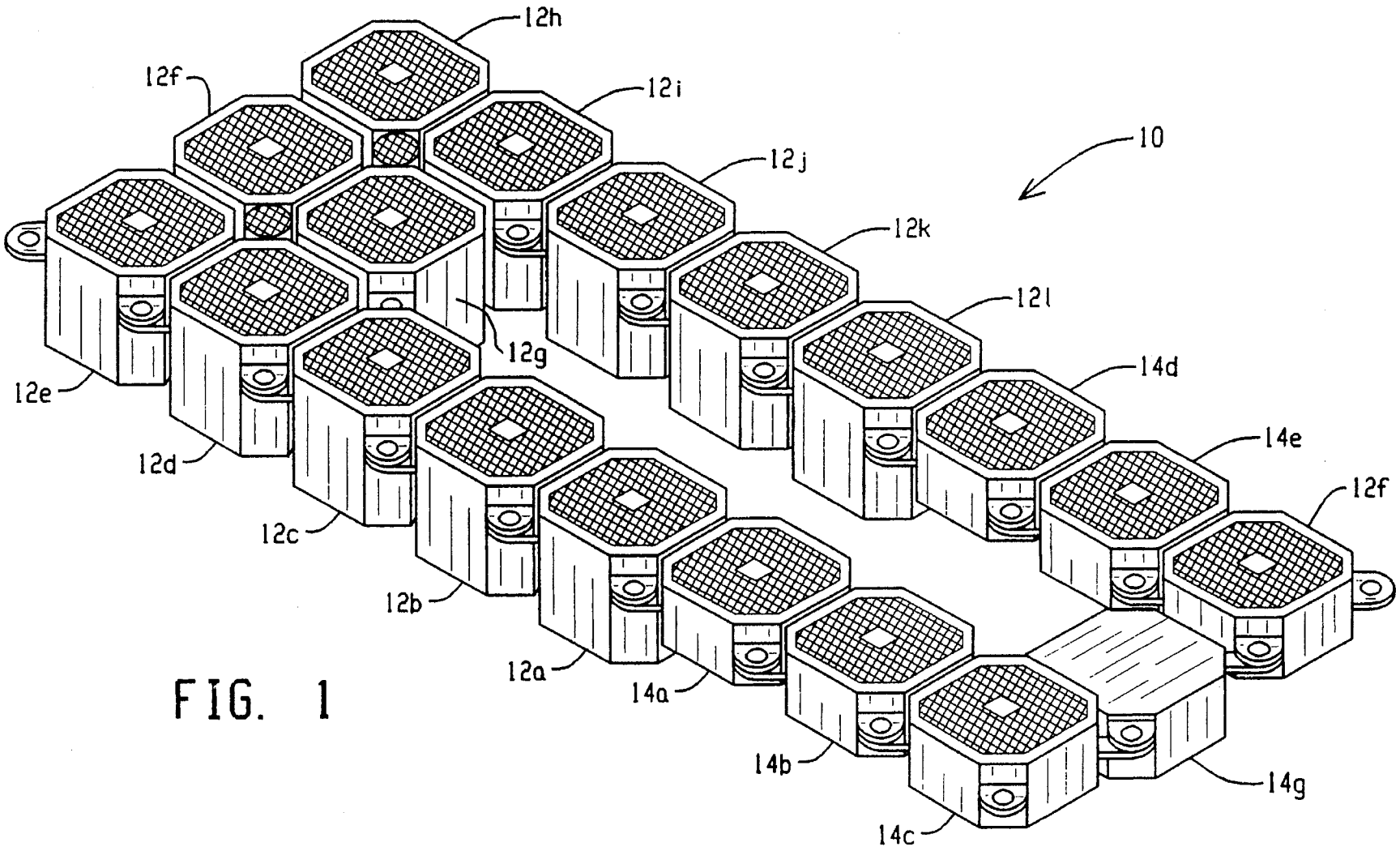
FIG. 1 is a schematic perspective illustration of a dock for a personal watercraft assembled according to the present invention from tall floatation units and from short floatation units.
Figure 2:
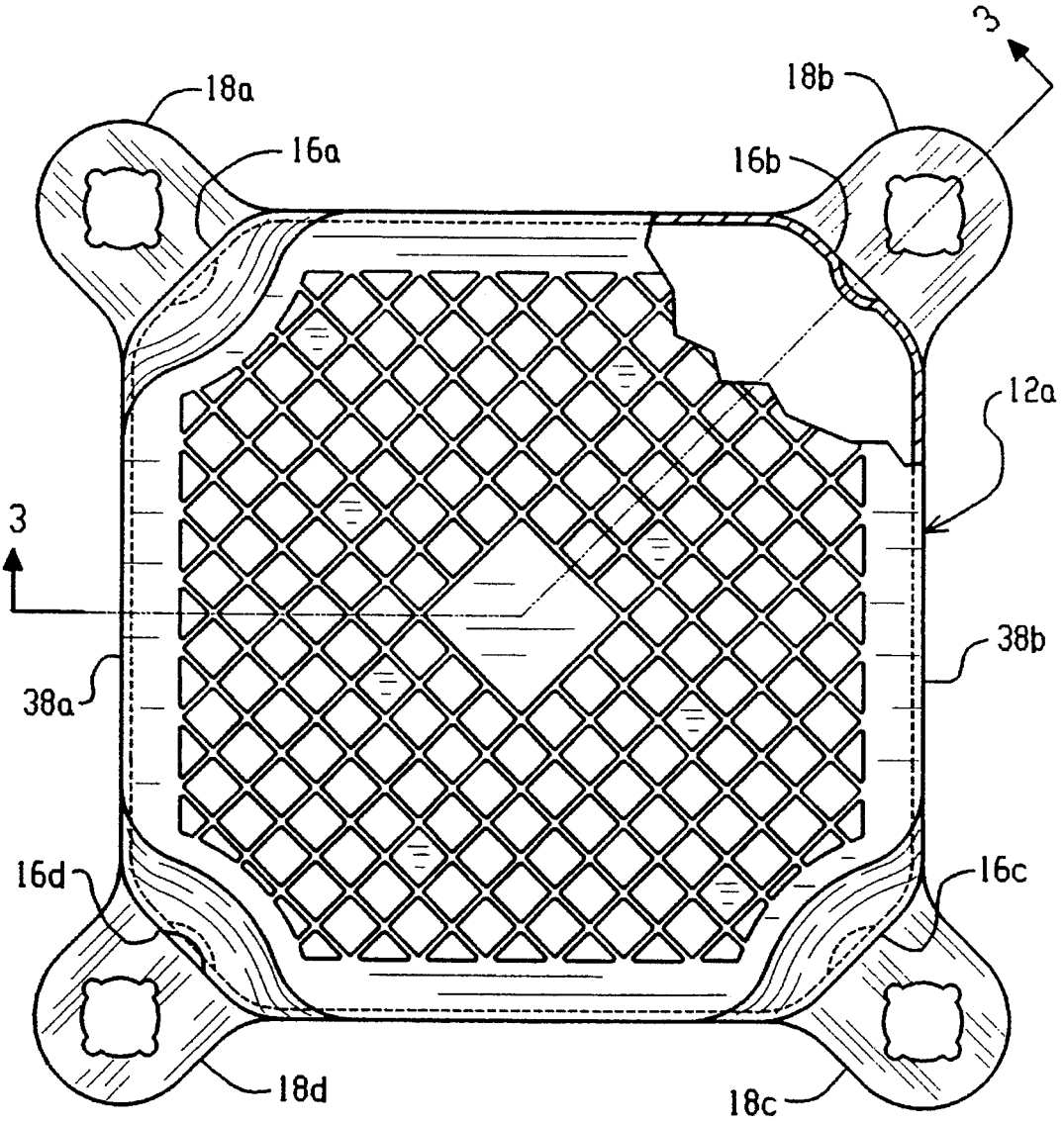
FIG. 2 is a plan view of a tall floatation unit of FIG. 1.
Figure 3:
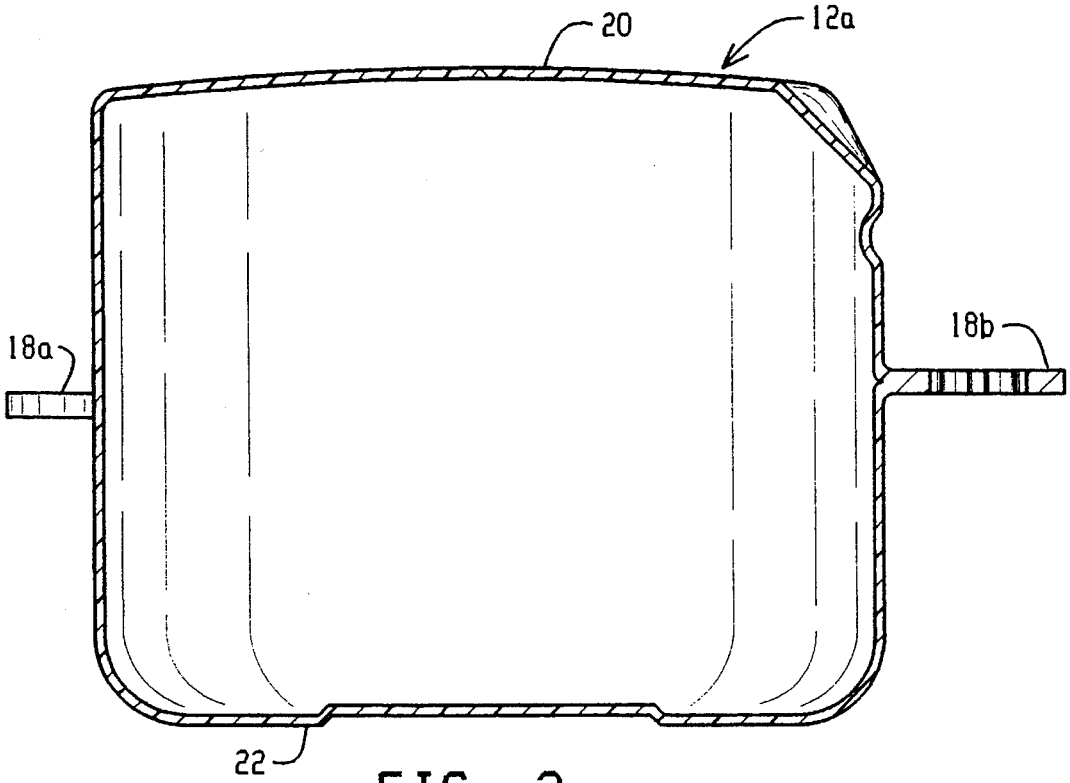
FIG. 3 is a view looking in the direction of arrows 3—3 of FIG. 2.

The dock 10 shown in FIG. 1 is constructed in accordance with the present invention. The dock 10 is formed of identical, tall floatation units 12*a–l* and identical short floatation units 14*a–g*. All of the floatation units 12*a–l* and 14*a–g* are hollow and air-tight. FIGS. 2 and 3 show a plan and vertical section view, respectively through the tall floatation unit 12*a* of FIG. 1. The tall floatation units 12*a–l* are substantially similar to that shown in U.S. Pat. Nos. 3,824,644 and 4,604,962, and the disclosure of these patents is incorporated in its entirety into this application. Because the tall units 12*a–l* are substantially all identical to each other, in this specification the reference numeral 12 without a suffixed letter is used to designate a tall unit generically, while the specific suffixes are used to refer to particular tall units. Similar nomenclature is used in connection with the short units 14*a–g*.

The tall unit 12 (FIGS. 2 and 3) is generally cubical, although the vertical edges 16*a–d* are beveled as shown in FIG. 2. Tabs 18*a–d* project from each beveled edge 16*a–d*, respectively. The tabs, as in the prior art, are vertically staggered to facilitate connecting each floatation unit 12 to its neighbor, as illustrated schematically in FIG. 1.

The tall unit 12 is about 16.25 inches tall from the crown of the top or deck surface 20 to the bottom wall 22. The tall unit is about 19.75 inches on a side in plan view. Thus the tall units 12 are roughly cubical. The tabs 18*a–d* are positioned down from the top or deck surface 20 from about 5.5 inches to about 7.5 inches down from the top surface. By staggering the distance down from the deck surface 20 of the tabs 18*a–d* it is possible to connect the tall floatation units with their deck surfaces 20 approximately coplanar so as to make a deck surface for the floating dock 10 that is more or less flat and without any abrupt steps.

Figure 4:
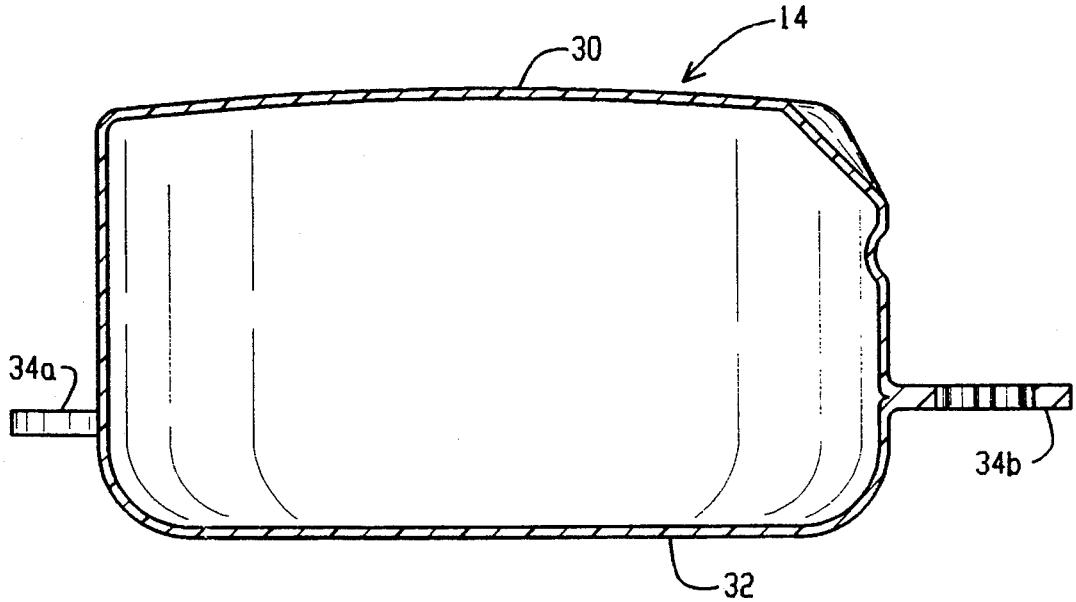
FIG. 4 is a section view similar to FIG. 3, but showing a short floatation unit.

The short floatation units 14 (FIGS. 1 and 4) are similar to the tall units 12 except in the distance from the tabs to the bottom wall. The short floatation units 14 are about 10 inches tall, but have the same plan view layout as the tall units 12. In other words the plan view shown in FIG. 2 of a tall unit 12 is indistinguishable from a similar view of a short floatation unit 14. However, the elevation view, shown in FIG. 4, shows the short floatation units 14 to be approximately 10 inches tall from the crown of their top surfaces 30 to their bottom walls 32. The tabs 34*a–d* (only two shown in FIG. 4) of the short units are identical to the corresponding tabs of the tall floatation units 12, and they are vertically positioned along the beveled corners (not shown) of the short floatation units the same distance down from the top or deck surface 30 as are the corresponding tabs of the tall units. As a consequence of this arrangement, the short units 14 can be interconnected with the tall units 12, and the deck surface produced will be essentially flat and without any abrupt steps.

All the floatation units 12 and 14 are manufactured of High Density Polyethylene (HDPE). This material has proven to be extremely rugged and to resist corrosion as well as the attachment of marine flora and fauna. Moreover, in the sections used HDPE exhibits an appropriate balance between flexibility and stiffness. The tabs 18*a–d* and 34*a–d* are slightly more than one-half inch thick. Each of these tabs has a central opening through which a fastener may be placed. Fasteners and openings like those shown in U.S. Pat. No. 3,824,644 have proved suitable for connecting floatation units 12 and 14 to each other where there are four tabs to be joined. Where three or fewer tabs are to be joined, a plastic nut and bolt assembly 35 (FIG. 5) of conventional design may be used.

When joined together, the floatation units 12 and 14 show some flexibility relative to one another. This is a desirable feature in an object such as a dock that will be subject to a variety of forces from people walking on it to watercraft being driven on it to tides and storms. Some flexibility enhances the life of the structure over a completely stiff structure.

Figure 5:
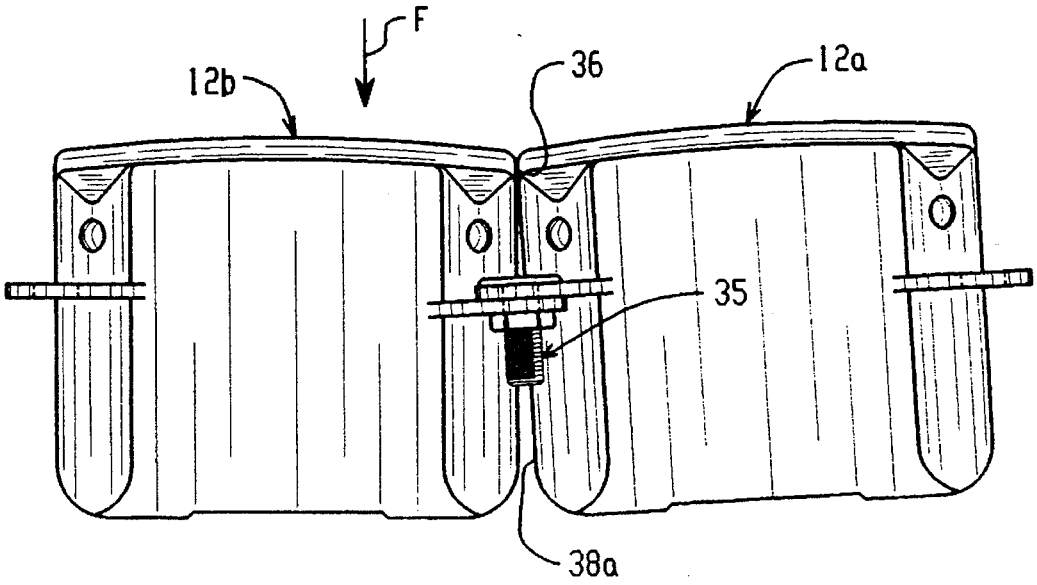
FIG. 5 is a schematic illustration of two tall floatation units flexed by a downward force, F, to bring their top corners into contact.
Figure 6:
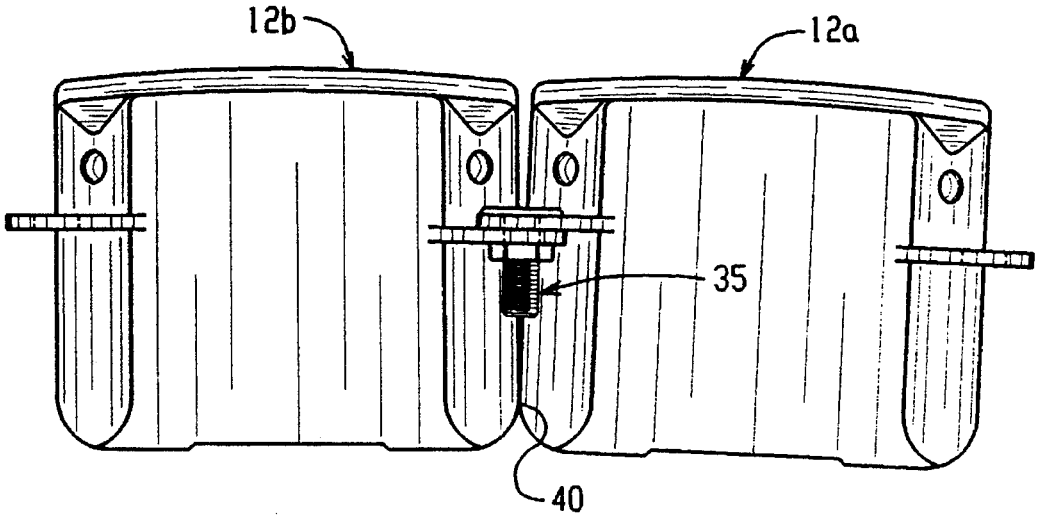
FIG. 6 is a view similar to FIG. 5, showing the same tall floatation units flexed in the opposite direction to bring their bottom corners into contact.

The position of the tabs 18*a–d* relative to the deck surface 20 and bottom wall 22 limit the amount of flexion that two tall floatation units 12 can exhibit relative to each other. As shown, for example in FIG. 5, adjacent tall units 12*a* and 12*b* are fastened to each other by the tabs which are located at about the horizontal midline of the tall floatation units 12. When, for example, a force F is applied to floatation unit 12*b* tending to rotate it clockwise around the tabs, the top corners of units 12*a* and 12*b* are pressed together, as shown at 36 in FIG. 5 and relative pivoting movement is substantially limited. Rotation of no more than a few degrees is permitted before the top corners come into contact as shown at 36 in FIG. 5. Similarly rotation in the opposite direction is limited by contact of the bottom corners as shown in FIG. 6 at 40. Again, only a few degrees of rotation is possible before contact between the bottom corners.

Figure 7:
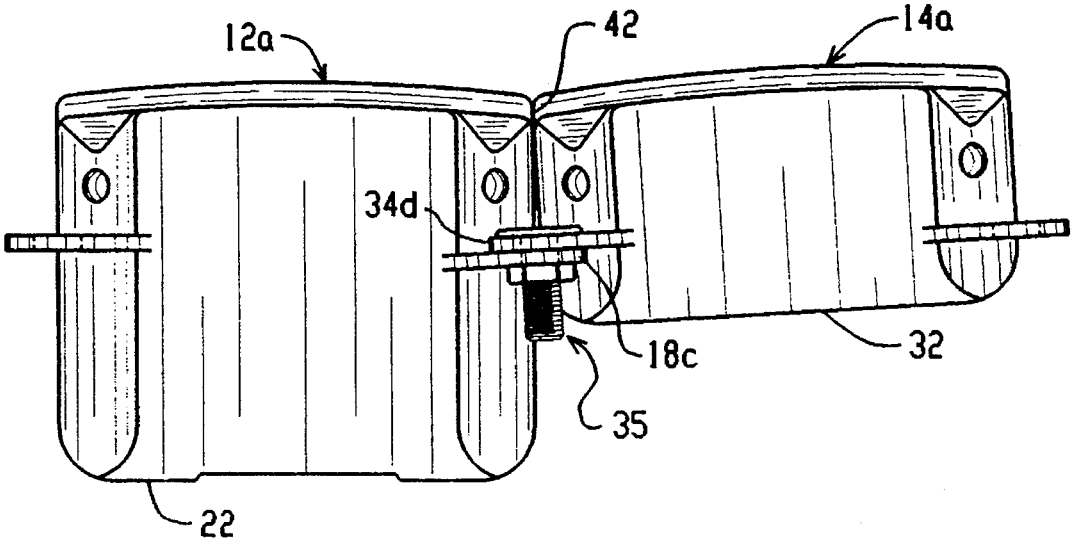
FIG. 7 is a schematic view of a tall floatation unit connected to a short floatation unit and showing the units flexed to bring their top corners into contact.
Figure 8:
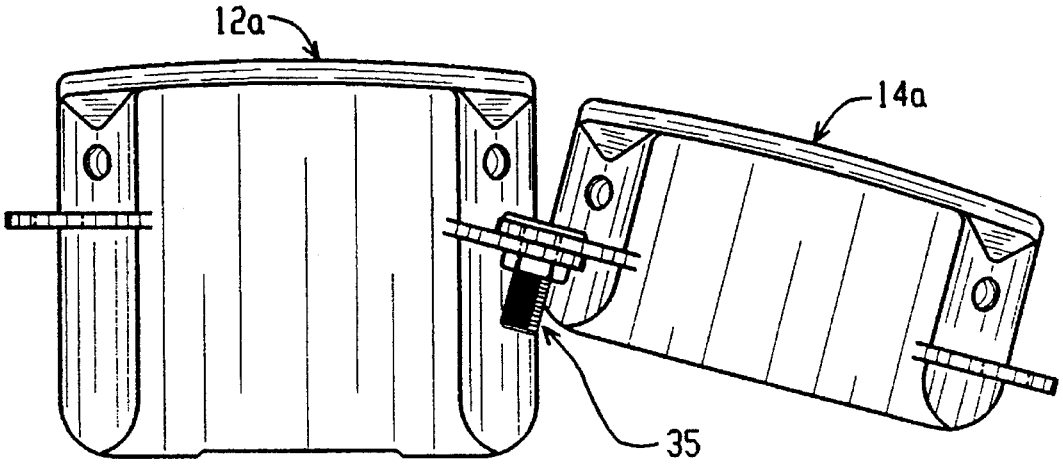
FIG. 8 is a view similar to FIG. 7 but showing the short unit flexing away from the tall unit.

The connection between a short floatation unit 14 and a tall unit 12 (FIGS. 7 and 8) or between two short units 14 results in different permitted motion. The tabs 34*a–d* are much closer to the bottom surface 32 of the short unit 14 than are the corresponding tabs of the units 12. Therefore, the short units 14 can flex substantially in one direction, while flexion in the opposite direction is limited the same as for the tall floatation units 12. For example, as illustrated in FIG. 7, the short floatation unit 14*a* is connected to the tall floatation unit 12*a* by suitable fasteners 35 joining tabs 18*b* and *c* of the tall unit with tabs 34*a* and *d* of the short unit, respectively. The short floatation unit 14*a* is free to rotate clockwise around the tabbed connection as shown in FIG. 8 because of the flexibility of the tabs and their location near the bottom 32 of the short floatation unit. However, rotation of the short unit 14*a* in the counterclockwise direction is limited by contact between the top corners of the short and tall units as shown at 42. Depending on the amount of force applied, the short unit 14*a* can rotate in a clockwise sense (as viewed in FIG. 8) as much as 10°–15°. When two short units are connected to each other the permitted motion is slightly greater.

The asymmetry of permitted bending permits a unique dock to be assembled using both short and tall floatation units. As illustrated in FIGS. 1 and 11–14, a dock 10 for a personal watercraft (e.g., a jet ski) is assembled from both short floatation units 14 and tall floatation units 12. A row of three tall units 12*e, f,* and *h* (FIG. 9), are closest to the shore or a permanent conventional dock (not shown). Outward from them is another row consisting of tall units 12*d, g,* and *i*. Together the six tall units 12*d–i* form a rectangular base 50.

Two arms 52 and 54 extend from the base 50. The arm 52 is formed of tall units 12*c,* 12*b,* and 12*a* followed by short units 14*a,* 14*b,* and 14*c* in that order. See FIG. 9. The arm 54 is composed of tall units 12*j,* 12*k,* and 12*l* followed by short units 14*d,* 14*e,* and 14*f*.

Figure 9:
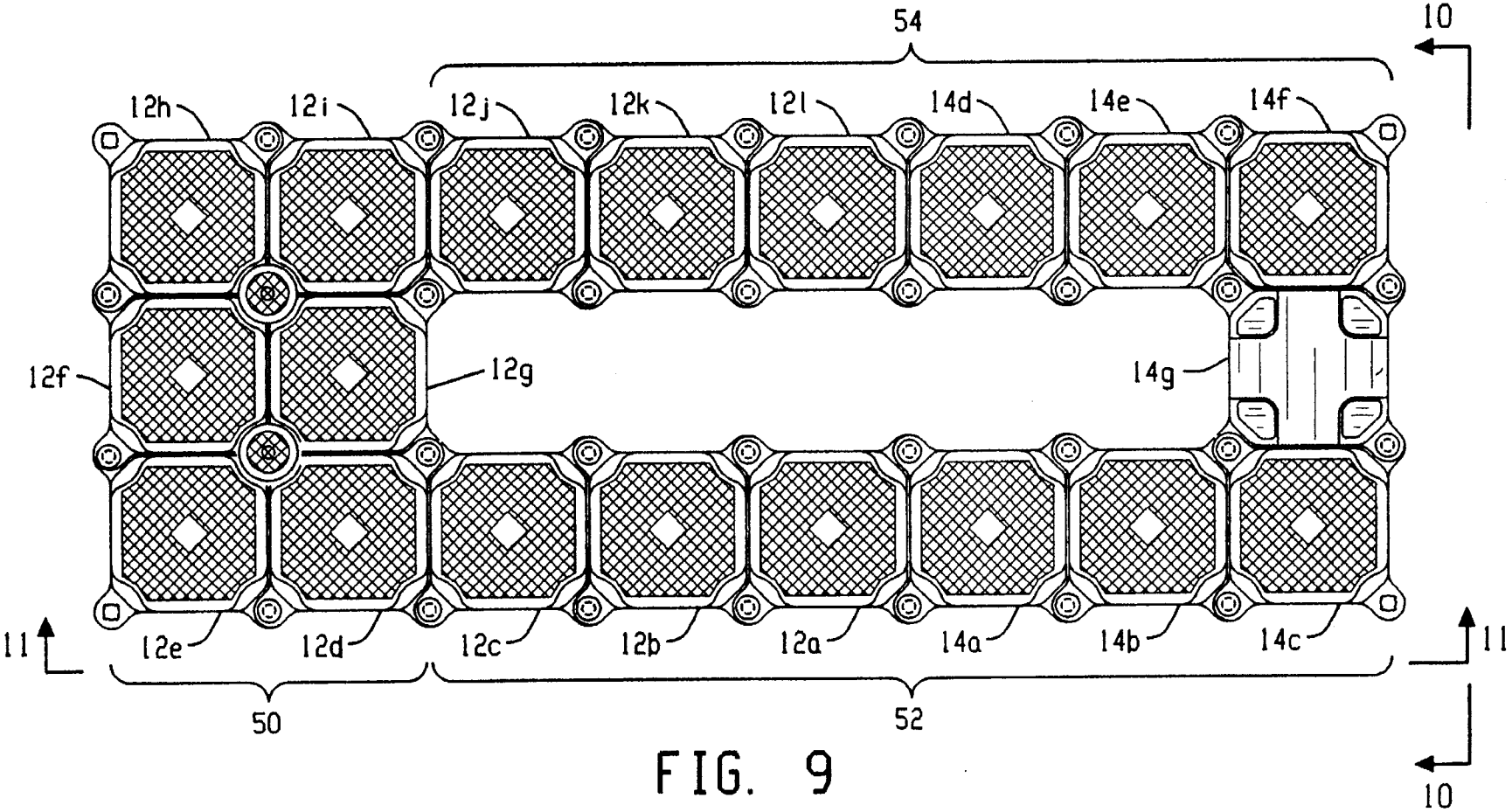
FIG. 9 is a plan view of the dock of FIG. 1.
Figure 10:
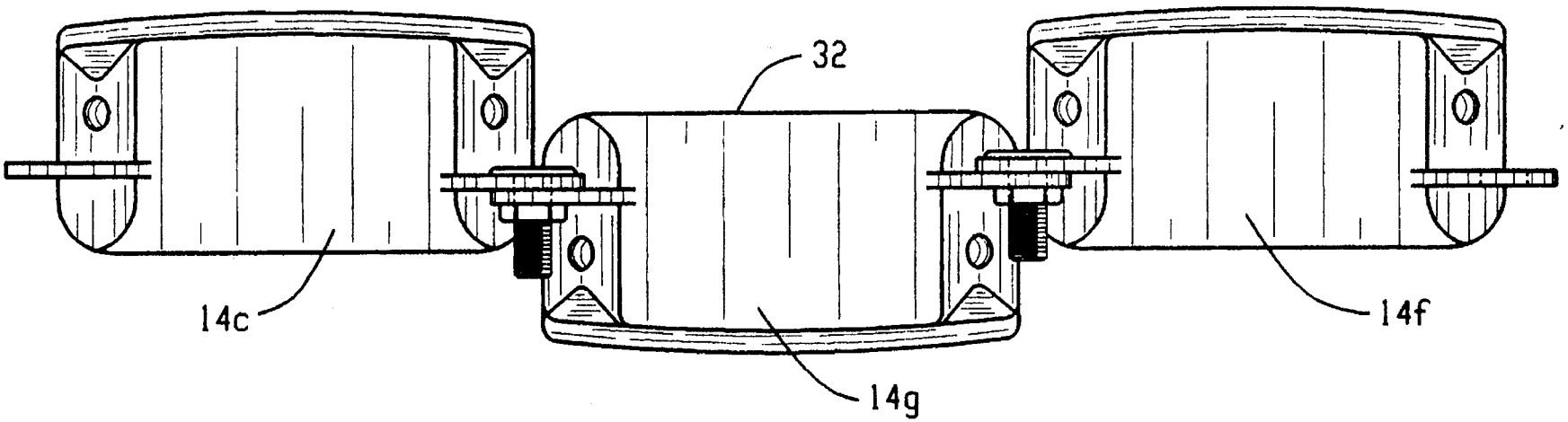
FIG. 10 is a view looking in the direction of arrows 10—10 of FIG. 9.
Figure 11:
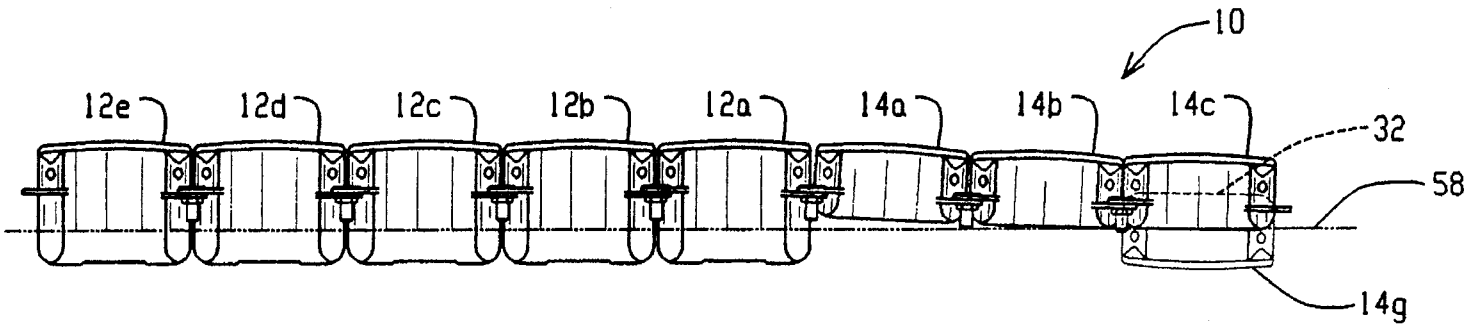
FIG. 11 is a view looking in the direction of arrows 11—11 of FIG. 9 showing the dock in the water and unloaded.
Figure 14:
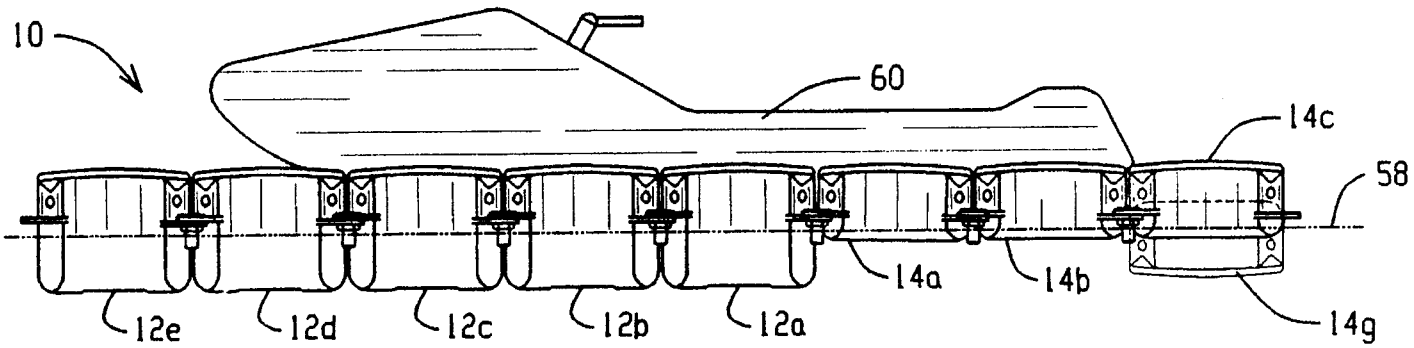
FIG. 14 is a view generally like FIG. 12, but showing the craft in place on the dock.

The distal ends of arms 52 and 54 are connected to each other by an inverted or upside down short unit 14*g* (FIGS. 9 and 10). The short unit 14*g* connects the units 14*c* and 14*f* which form the ends of the arms 52 and 54, respectively, and keep the arms from splaying outward when a craft is driven between them. The short units 14 are proportioned so that the surface 32 of unit 14*g* (the "bottom surface" when the unit 14*g* is right side up) is above the water level 58 when the dock 10 is floating unloaded (FIG. 11) and when it is loaded (FIG. 14). This results in a surface 32 of the inverted short unit 14*g* that is free of marine growth that might scratch or otherwise damage the bottom of a personal watercraft.

Figure 15:
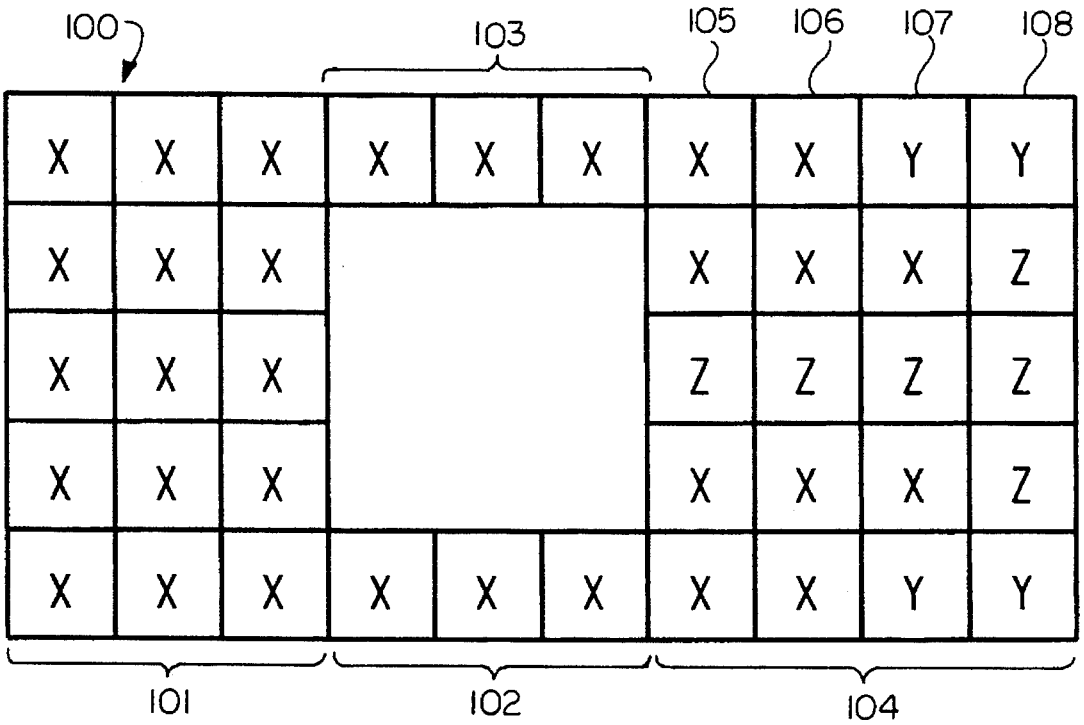
FIG. 15 is a schematic plan view of a dock assembled according to the present invention for a small craft such as a jet boat.
Figure 16:
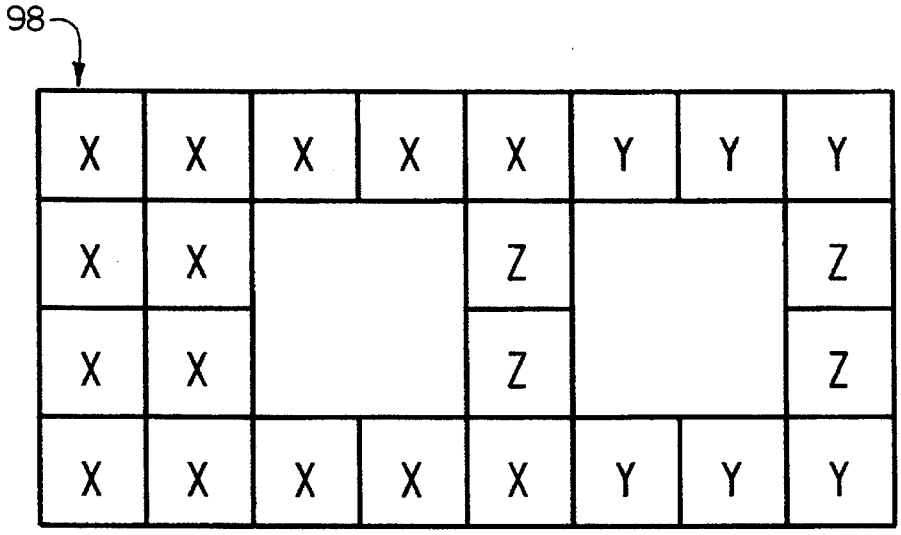
FIG. 16 is a view similar to FIG. 16, but showing a dock assembled for yet a different craft.

It will be understood that the dock 10 is illustrative only, and that other configurations are possible to accommodate different sizes and types of craft. For example, docks may be assembled for use with jet boats, outboard motor boats, sailboats with centerboards, and small craft generally, namely craft under about 18 feet in length. Moreover, docks may be assembled with slips for two or more watercraft without departing from the scope of the invention. By way of example FIGS. 15 and 16 show different docks that can be assembled from the tall flotation units 12 and the short flotation units 14. In FIGS. 15 and 16, plan views of docks are shown, with the tall units being indicated by squares marked "x", the short units being indicated by "y", and the inverted short units being indicated by squares with the letter "z". The dock 100 illustrated in FIG. 15 may be especially suited for a craft such as a jet boat, up to about 18 feet in length. The dock 98 in FIG. 16 is more suitable for a somewhat smaller craft.

Figure 12:
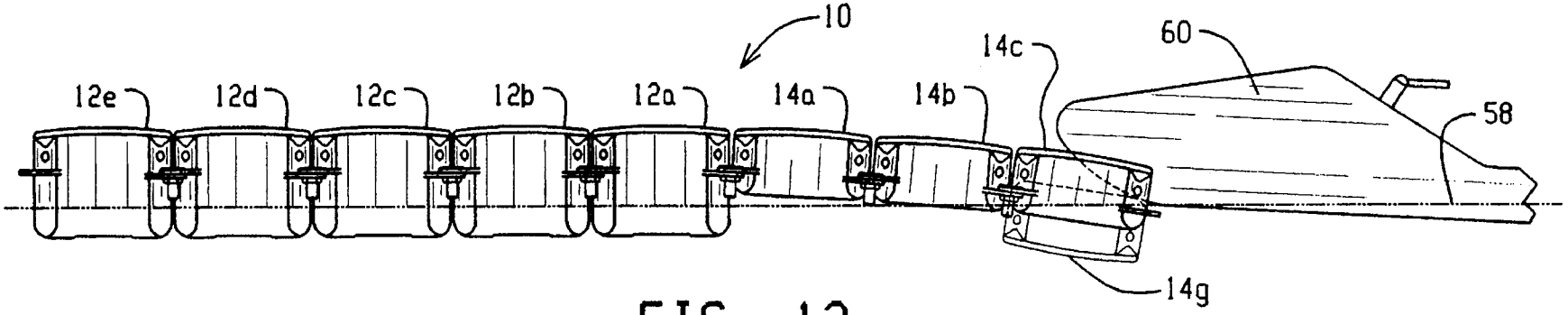
FIG. 12 is a view generally similar to FIG. 11 but showing a craft approaching the dock and the downward flexion of the short floatation units.
Figure 13:
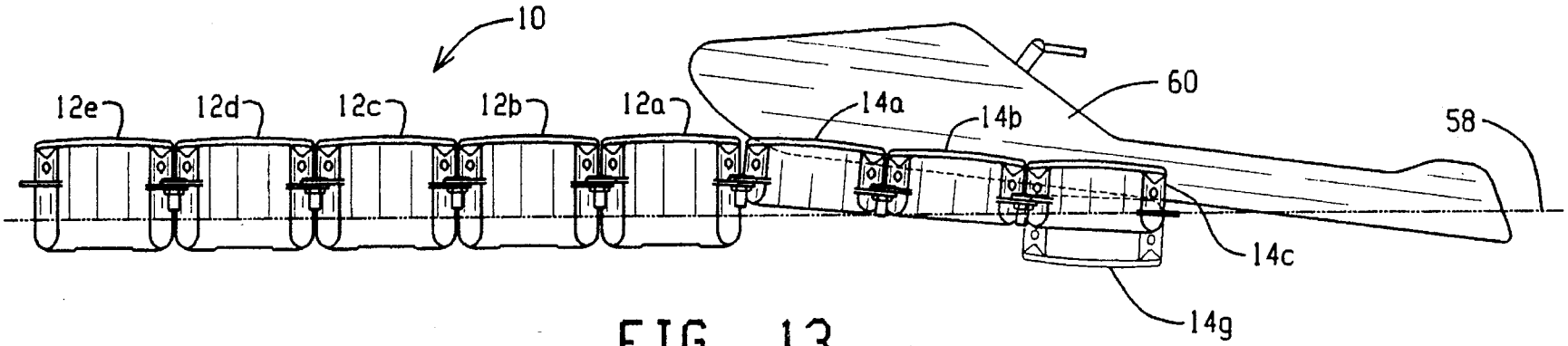
FIG. 13 is a view generally like FIG. 12 but showing the craft partially on the dock.

In use, a watercraft 60 may be ridden onto the dock 10. This is done by centering the craft between the arms 52 and 54 with the keel of the craft on the surface 32 of the inverted short unit 14*g*, as shown in FIG. 12. Then a short burst of power is applied to the craft 60 by gunning its engine. The craft 60 moves forward (FIG. 13), and its momentum carries it to its rest position (FIG. 14). During this process the short units 14*a–c* and 14*d–f* flex downward (see FIG. 13) as the weight of the craft is imposed initially on the distal ends of arms 52 and 54 (FIG. 9). The connection between the short units 14 illustrated in FIG. 8 makes this possible because the short units are initially forced to flex in a clockwise direction as viewed in the Figures. However, as motion of the craft 60 proceeds, the forces applied tend to rotate the floatation units 12 and 14 in the opposite direction, bringing the top corners of the units into contact and limiting the rotation motion, as shown in FIGS. 5 and 14.

The craft 60, once it is on the dock 10, is completely out of the water and is supported by the two arms 52 and 54 which support the hull of the craft on opposite sides of its keel. Thus the craft is stabilized against rocking movement. At the same time the weight of the craft supplies a downward force tending to press the top corners of the floatation units 12 and 14 together so that the dock 10 becomes essentially rigid.

The dock 100 illustrated in FIG. 15 operates in a slightly different manner than those illustrated in the other Figures. Specifically, because jet boats are significantly heavier than personal water craft such as jet skis, additional buoyancy is necessary. Accordingly, the dock 100 includes a bow portion 101 formed of tall floatation units 12 connected together as discussed above. The bow portion is five units wide. Two arms 102 and 103 extend toward the stern and are each formed from three tall floatation units in series. The stern portion 104 of the dock is formed of four rows of floatation units, with five units in each row. In rows 105 and 106, all the floatation units are tall units 12, except the center one in each row, which is an inverted short unit 14. In the next row 107 again the center unit is an inverted short unit 14. A tall unit 12 is located on each side of the central, inverted short unit 14 and a short unit is located on the end of each row, this time right side up. The final row 108 of the stern portion 104 is assembled entirely from short units 14, with the center three being inverted. The arrangement shown in FIG. 15 defines a broad flat deck formed from the top surfaces of all the floatation units except the inverted short units, marked "z". The inverted units, "z", define a lowered center portion to receive and guide the keel of the craft into place on the dock. The surrounding tall floatation units, "x", provide the bouyancy necessary to support the jet craft high and dry when it is on the dock, while the short units, "y", in rows 107 and 108 reduce the bouyancy enough to allow the stern portion 104 to be depressed as the craft is driven onto the dock 100.

Thus it is clear that the present invention provides a unique floating, drive-on dry dock 10 for a small watercraft such as a personal watercraft 60. The dock 10 is assembled from a combination of tall floatation units 12 and short floatation units 14. The tall units 12 are roughly cubical and have tabs 18*a–d* projecting from about midway along each vertical edge. The short units 14 have tabs 34*a–d* positioned to make a deck continuous with the deck formed by the tall units 12 and which are able to flex downward when the craft 60 is driven onto the dock 10 but which resist flexion in the opposite direction when the craft is in place, to therefore form a rigid, stable surface that can be walked on.

Accordingly, the present invention provides a floating, drive-on dry dock 10 formed from a plurality of float units each with a generally flat top or deck surface, the float units being connected together so that their top surfaces 20, 30 form a generally planar and horizontal deck. Each float unit 12, 14 has at least one side wall, e.g., 38*a,* 38*b,* which faces an opposing side wall on an adjacent float unit. The float units each have a pivotable connection to the adjacent float units, the connections being above the water line 58 when the dock is floating freely and a fixed distance below the deck surface of the float unit. The connections enable adjacent float units 12, 14 to rotate with respect to each other until the respective facing side walls come into contact with each other. A first group of the float units, the tall units 12, have bottom surfaces 22 located substantially as far below the pivotable connection as their deck surfaces 20 are above the pivotable connection whereby they can rotate downward to the same extent that they can rotate upward before the respective facing side walls come into contact with each other, as shown in FIGS. 5 and 6.

A second group of float units, the short units 14, have bottom surfaces 32 located substantially closer to the pivotable connection whereby they can rotate downward substantially without limitation as shown in FIG. 8. The floating dock 10 has a pair of parallel arms 52 and 54 formed at least in part of float units from the second group of float units, and there is a bridging unit 14*g* between the parallel arms, the bridging unit having a top surface 32 which is above the water surface 58 when the dock 10 is floating freely.

The floating, drive-on dry dock 10 so constructed has surfaces on which the watercraft 60 slides which are submerged only while the watercraft is being ridden onto the dock, but which remain above the surface both before and after the craft is driven onto the dock. The result is a dock 10 that does not accumulate barnacles or other harmful marine growth. Moreover, the ability of the short units 14 to permit flexion in one direction but not in the other permits them to flex downward while a watercraft is being driven onto the dock and to form a rigid deck once the craft is in place.

In a further aspect of the present invention, a dock 10, 98, or 100 (FIGS. 1, 15 and 16) is formed a number of interconnectable floatation units. The units are arranged so that the dock has a generally planar deck defining a bow end portion, a pair of arms leading toward the stern from the bow end portion and a guide portion connected between the arms having a top surface below that of the deck for receiving and guiding the keel of a boat.

What is claimed is:

1. A floating dock assembly for a watercraft, said assembly comprising a plurality of floatation units connected to each other to form a base and a pair of arms extending from the base; the units of the base being joined to each other for limited relative movement so as to form a substantially rigid structure, and flexible connections between at least some of the units of each arm, the flexible connections between the units permitting each unit to pivot upward with respect to its immediately adjoining unit to a first limited extent and downward with respect to the same adjoining unit to a substantially greater extent.

2. The dock assembly of claim 1 further including a member connecting the ends of the arms remote from the base.

3. The assembly of claim 2 wherein the member includes a top surface which is above the water line when the dock is free of a watercraft.

4. The assembly of claim 3 wherein the top surfaces of the member are below the water line only while a watercraft is being placed on the assembly.

5. The assembly of claim 1 wherein the arms engage the hull of the craft on opposite sides of the keel of the craft.

6. The assembly of claim 1 comprising a first set of floatation units, the first set of floatation units each having a substantially flat top surface joined to sides and a bottom surface to form a hollow floatation unit and having tabs projecting from the sides, the tabs on one floatation unit being connectable to the tabs of the adjacent unit so as to connect the units to each other, the tabs of the first set of floatation units being approximately at the horizontal midline of the first set of floatation units, and a second set of floatation units, the second set of floatation units each having a substantially flat top surface joined to sides and a bottom to form a hollow floatation unit of lesser volume than the floatation units of the first set, and tabs projecting from the sides of the floatation units of the second set, the tabs of the second set being positioned so that when the tabs of floatation units of the first and second sets are connected, the top surfaces of all the floatation units are substantially coplanar.

7. The assembly of claim 6 wherein the tabs of the second set of floatation units are positioned to enable the floatation units of the second set to rotate from an initial position in which their top surfaces are substantially coplanar more in one direction than in the other.

8. A floating, drive-on dry dock onto which a watercraft may be driven, the dock comprising: a plurality of floating units connected to each other, the dock having a proximal end and a distal end, whereby a craft may approach the dock from the distal end, first means for connecting the floating units at the proximal end of the dock to each other so that they have limited and substantially equal angular movement about a horizontal axis relative to each other, and second means for connecting the floating units at the distal end of the dock to each other so that they have limited angular movement relative to each other about a horizontal axis in one angular direction and substantially greater angular movement relative to each other in the opposite angular direction about said horizontal axis.

9. A floating, drive-on dry dock comprising a plurality of tall float units and a plurality of short float units, the tall and short float units being joined to each other, the tall and short units each having substantially vertical side walls joined to each other at corners where the adjacent side walls meet, and the short and tall float units each having substantially horizontal top and bottom surfaces joined at edges with the side walls, the top and bottom surfaces of all the float units having substantially the same rectangular contour, and the side walls of the tall units being taller than the short units, all of the float units having flexible tabs extending generally horizontally outward from their corners and positioned to connect with tabs from adjacent float units, the tabs being adapted to position adjacent float units a predetermined distance from each other when their side walls are parallel, the tabs extending from tall float units being substantially midway along the vertical height of the tall float units, the tabs extending from the short float units being substantially the same distance down from the top surface of the short units as the tabs on the tall units are from the top surface of the tall units, the dock having a first end portion including a plurality of tall float units with their tabs connected to each other, and a second end portion including a plurality of short float units with their tabs connected to each other, tabs on the first and second portions being connected to each other, whereby the units in the first portion are free to pivot about a horizontal axis through the tabs in an upward and downward direction until the top and bottom surfaces, respectively, of adjacent units come into contact, the extent of rotation about said axis being substantially equal in both directions from an initial position in which the adjacent side walls are parallel, and the units in the second end portion of the dock are free to pivot upward about a horizontal axis through the tabs to the same extent as the units in the first end portion and downward about said axis a substantially greater extent.

10. The dock of claim 9 wherein the second end portion includes a pair of arms extending from the first end portion parallel to each other, the arms being connected to each other to maintain their parallel relationship.

11. The dock of claim 9 wherein the second end portion includes a pair of arms each formed at least of connected short float units, said arms extending from the first end portion of the dock parallel to each other, and a short float unit connected between the arms to maintain the arms parallel to each other.

12. The dock of claim 11 wherein said short float unit between said arms is positioned upside down.

13. The dock of claim 11 including a plurality of short float units connected between said arms to maintain the arms parallel to each other.

14. A floating, drive-on dry dock formed from a plurality of float units each with a generally flat top surface, the float units being connected together so that their top surfaces are generally coplanar and horizontal, and each float unit having at least one side wall which faces an opposing side wall on an adjacent float unit, each float unit having a pivotable connection to the adjacent float units, the connections being above the water line when the dock is floating freely and a fixed distance below the top surface of the float unit and enabling adjacent float units to rotate with respect to each other until the respective facing side walls come into contact with each other, a first group of the float units having bottom surfaces located substantially as far below the pivotable connection as their top surfaces are above the pivotable connection whereby they can rotate downward to the same extent that they can rotate upward before the respective facing side walls come into contact with each other, a second group of float units having bottom surfaces located substantially closer to the pivotable connection whereby they can rotate downward substantially without limitation, said floating dock having a pair of parallel arms formed at least in part of float units from said second group of float units, and a bridging unit between said parallel arms, said bridging unit having a top surface which is above the water surface when the dock is floating freely.

15. A floating dock assembly for a watercraft, said assembly comprising a plurality of floatation units connected to each other to form a bow end portion, and a pair of arms extending from the bow end portion, the units of the bow end portion and the arms having top surfaces that are substantially coplanar to define a deck lying approximately in a plane, and floatation units connected between the arms having top surfaces below the plane of the deck to receive and guide a water craft being driven onto the dock and wherein the floatation units are generally square in plan view and have fasteners at their corners for connecting them to between one and three adjacent floatation units, some of the floatation units being tall units and having a first height, and some of the units being short units and having a second, shorter height, the floatation units connected between the arms being short units.

16. The dock of claim 15 wherein the floatation units have top surfaces and bottom surfaces that are substantially flat, the fasteners at the corners of the floatation units being positioned between the top and bottom surfaces of the tall units, the top surface of the short floatation units being above the fasteners on the tall units when the bottom surfaces of the tall and short units are resting in a common plane.

17. The dock of claim 16 wherein the fasteners are connected to the floatation units between the top and bottom surfaces, the fasteners on the shorter units being positioned so that when they are connected to the fasteners on the tall units with the top surface of the short unit uppermost, the top surface of the tall and short units are substantially coplanar.

18. The dock of claim 17 wherein the fasteners on the short units are positioned so that when a shorter unit is connected to a tall unit in an inverted position so as to have the top side of the short unit facing down, the upper most surface of the short unit is below the plane of the top surface of the tall unit to which it is connected.

19. The dock of claim 17 wherein the floatation units are hollow.

* * * * *